US008920297B2

(12) United States Patent
Maccagnani et al.

(10) Patent No.: US 8,920,297 B2
(45) Date of Patent: Dec. 30, 2014

(54) PRESSURE DEVICE FOR EXERTING PRESSURE ON AN OPENING DEVICE FITTED TO A PACKAGE OF A FOOD PRODUCT POURABLE INTO A TUBE OF PACKAGING MATERIAL

(75) Inventors: Andrea Maccagnani, Modena (IT); Inge Nilsson, Uddevalla (SE); Urban Johansson, Vanersborg (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 853 days.

(21) Appl. No.: 13/125,258

(22) PCT Filed: Nov. 14, 2009

(86) PCT No.: PCT/EP2009/065181

§ 371 (c)(1),
(2), (4) Date: Apr. 20, 2011

(87) PCT Pub. No.: WO2010/055149

PCT Pub. Date: May 20, 2010

(65) Prior Publication Data

US 2011/0203223 A1 Aug. 25, 2011

(30) Foreign Application Priority Data

Nov. 14, 2008 (IT) ..... TO2008A0842

(51) Int. Cl.
*B65B 61/18* (2006.01)

(52) U.S. Cl.
CPC ..... *B65B 61/186* (2013.01)
USPC ..... 493/87; 493/52; 53/133.2; 53/331.5

(58) Field of Classification Search
CPC ..... B65B 61/186; B65B 61/18
USPC ..... 493/87, 114, 213, 927, 102, 103; 53/133.2, 317, 319, 133.3, 133.4, 329, 53/331.5, 336, 410; 156/69, 514
See application file for complete search history.

(56) References Cited

U.S. PATENT DOCUMENTS 6,035,604 A 3/2000 Gustafsson
8,499,529 B2 8/2013 Skarin et al.

(Continued)

FOREIGN PATENT DOCUMENTS

EP 0943549 A1 9/1999
EP 1 462 370 A1 9/2004

(Continued)

OTHER PUBLICATIONS

International Search Report (PCT/ISA/210) issued on Mar. 17, 2010, by European Patent Office as the International Searching Authority for International Application No. PCT/EP2009/065181.

(Continued)

*Primary Examiner* — Thanh Truong
*Assistant Examiner* — Tara M Ho
(74) *Attorney, Agent, or Firm* — Buchanan Ingersoll & Rooney PC

(57) ABSTRACT

A pressure device for exerting pressure on an opening device fitted to a package of a food product pourable into a tube of packaging material, the device having a first pressure member movable between a first work position, in which it presses a first area of the opening device against the package, and a first rest position, in which it is detached from the opening device; and a second pressure member movable between a second work position, in which it presses a second area of the opening device against the package, and a second rest position, in which it is detached from the opening device; the first and second area being crosswise to each other.

22 Claims, 7 Drawing Sheets

(56) References Cited

U.S. PATENT DOCUMENTS

| | | | | |
|---|---|---|---|---|
| 2001/0052215 | A1* | 12/2001 | Hiramoto et al. | 53/133.2 |
| 2006/0236655 | A1* | 10/2006 | Cavilli et al. | 53/133.1 |
| 2009/0261154 | A1 | 10/2009 | Scheu | |
| 2010/0218456 | A1 | 9/2010 | Skarin et al. | |

FOREIGN PATENT DOCUMENTS

| | | | |
|---|---|---|---|
| EP | 1462370 | A1 | 12/2006 |
| EP | 1 813 533 | A1 | 8/2007 |
| EP | 1813533 | A1 | 1/2009 |
| RU | 2141915 | C1 | 11/1999 |
| WO | 2006092369 | A1 | 9/2006 |
| WO | WO 2006/092369 | A1 | 9/2006 |

OTHER PUBLICATIONS

Written Opinion (PCT/ISA/237) issued on Mar. 17, 2010, by European Patent Office as the International Searching Authority for International Application No. PCT/EP2009/065181.

Decision to Grant issued by the Russian Patent Office in the Russian counterpart patent application No. 2011123767, dated Feb. 17, 2014 and the English translation (15 pages).

* cited by examiner

PRESSURE DEVICE FOR EXERTING PRESSURE ON AN OPENING DEVICE FITTED TO A PACKAGE OF A FOOD PRODUCT POURABLE INTO A TUBE OF PACKAGING MATERIAL

TECHNICAL FIELD

The present invention relates to a pressure device for exerting pressure on an opening device fitted to a package of a food product pourable into a tube of packaging material.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as TETRA BRIK ASEPTIC (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name TETRA REX (registered trademark).

Once formed, the above packages may undergo further processing, such as applying a reclosable opening device to protect the food product inside the package from contact with external agents, and to enable the product to be poured out.

At present, the most commonly marketed opening devices comprise an annular frame defining a pour opening and fitted about a removable or pierceable portion of a top wall of the package; and a cap hinged or screwed to the frame, and which is removable to open the package.

The removable portion of the package may be defined by a sealing sheet glued or heat-sealed to the outside of the package to close a through hole in the package. One example of this solution is described and illustrated in Patent Application EP-A-9433549. Alternatively, the removable portion of the package may be defined by a so-called "prelaminated" hole, i.e. a hole formed in the base layer of the packaging material before covering the base layer with other layers defining the packaging material, e.g. the layers of thermoplastic material and/or the layer of barrier material, which close the hole hermetically.

In the case of aseptic packaging machines, the opening devices are normally fitted directly to the packages, after they are formed, downstream from the packaging machine.

More specifically, the opening devices are fed successively through a gluing unit and a unit for applying them to the respective packages.

In the gluing unit, the opening devices are coated with adhesive, usually hot-melt glue.

Next, the opening devices are fed successively through a pressure unit, in which they are held by pressure on the respective packages long enough for the adhesive to cool and for each opening device to adhere to the package.

A need is felt for maximum flexibility as regards the shape and spatial orientation of the area of each opening device to which pressure is applied.

This is particularly so in the case of opening devices with a frame straddling an edge between a first and second wall, e.g. the top wall and a top end portion of a lateral wall, of the package, and comprising a first and second portion at an angle to each other and glued to the first and second wall respectively by respective fastening portions inclined with respect to each other.

DISCLOSURE OF INVENTION

It is an object of the present invention to provide a pressure device for exerting pressure on an opening device fitted to a sealed package of a product pourable into a tube of packaging material, and designed to achieve the above aim in a straightforward, low-cost manner.

According to the present invention, there is provided a pressure device for exerting pressure on an opening device fitted to a sealed package of a product pourable into a tube of packaging material, as claimed in claim 1.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
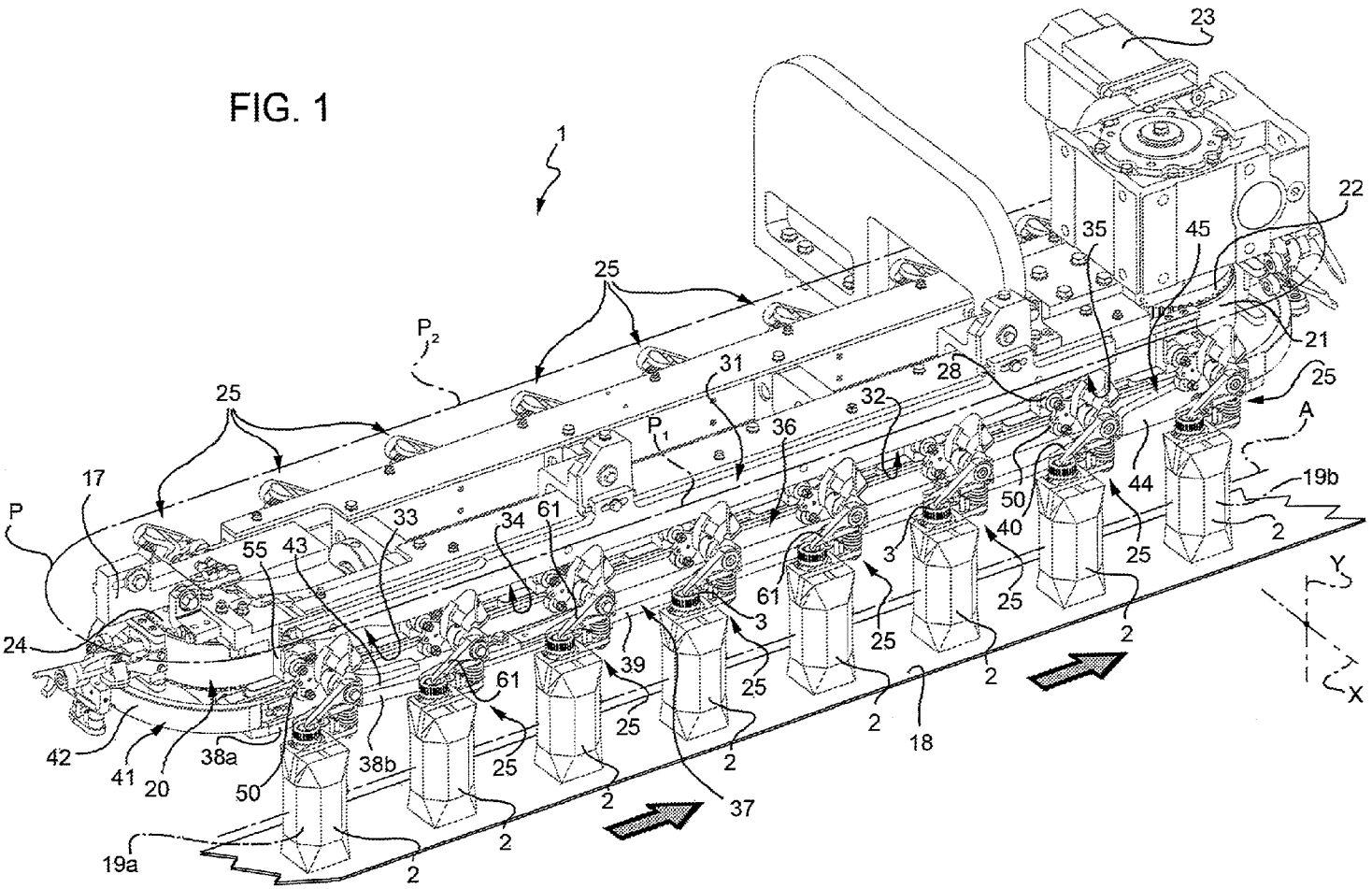
FIG. 1 shows a view in perspective of a pressure unit for applying pressure on opening devices fitted to respective packages of pourable food products, and comprising a number of pressure devices in accordance with the invention.
Figure 2:
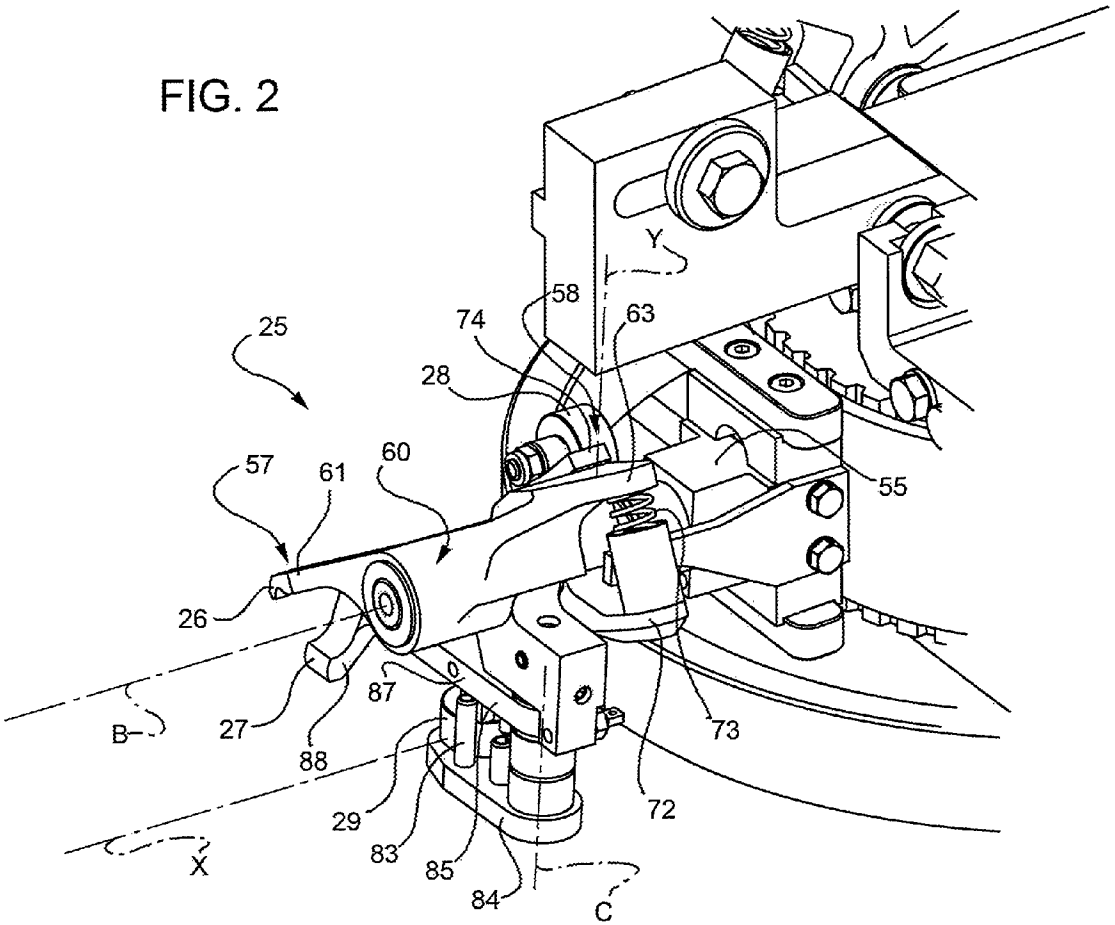
FIG. 2 shows an enlarged detail of FIG. 1.

With reference to FIGS. 1 and 2, number 1 indicates as a whole a pressure unit for exerting pressure on opening devices 3 fitted to respective packages 2 of food products pourable into a tube of packaging material.

Unit 1 can be incorporated in a known food product packaging machine (not shown) of the type described in the introduction.

Very briefly, a continuous tube is formed on the packaging machine from the web-fed packaging material. More specifically, the web of packaging material is first sterilized on the packaging machine with a sterilizing agent that is subsequently removed; and the sterilized web of packaging material is maintained in a closed, sterile environment, and is folded and sealed longitudinally to form a vertical tube of packaging material.

The tube of packaging material is filled with the sterilized or sterile-processed food product, and is sealed and subsequently cut along equally spaced cross sections to form pillow packs, which are then folded mechanically to form respective finished packages.

The machine preferably produces sealed packages 2 of a pourable food product, such as pasteurized or UHT milk, fruit juice, wine, etc.

The packaging machine may also produce sealed packages 2 of a food product which is pourable into the tube of packaging material when producing packages 2, and sets after the packages 2 are sealed. One example of such a food product is a portion of cheese, which is melted when producing packages 2, and sets after the packages are sealed.

Non-limiting examples of packages 2 produced on packaging machines of the type referred to above are the parallelepiped-shaped packages known by the trade name TETRA BRIK ASEPTIC (registered trademark) or so-called "gable-top" packages known by the trade name TETRA REX (registered trademark).

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages 2 for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of package 2 eventually contacting the food product.

Upstream from unit 1, opening devices 3 are fed successively through a gluing unit (not shown), and an application unit (not shown) on which they are fitted to respective packages 2.

More specifically, opening device 3 is applied to a removable portion of a respective package 2 (FIG. 6), i.e. a portion detachable from the rest of package 2 to pour out the pourable product.

The removable portion may be defined by a sealing sheet glued or heat-sealed to package 2 to close a through hole in the package. Alternatively, the removable portion may be defined by a so-called "prelaminated" hole, i.e. a hole formed in the base layer of the packaging material and closed hermetically by other layers (at least the layers of thermoplastic material) of the packaging material.

Figure 7:
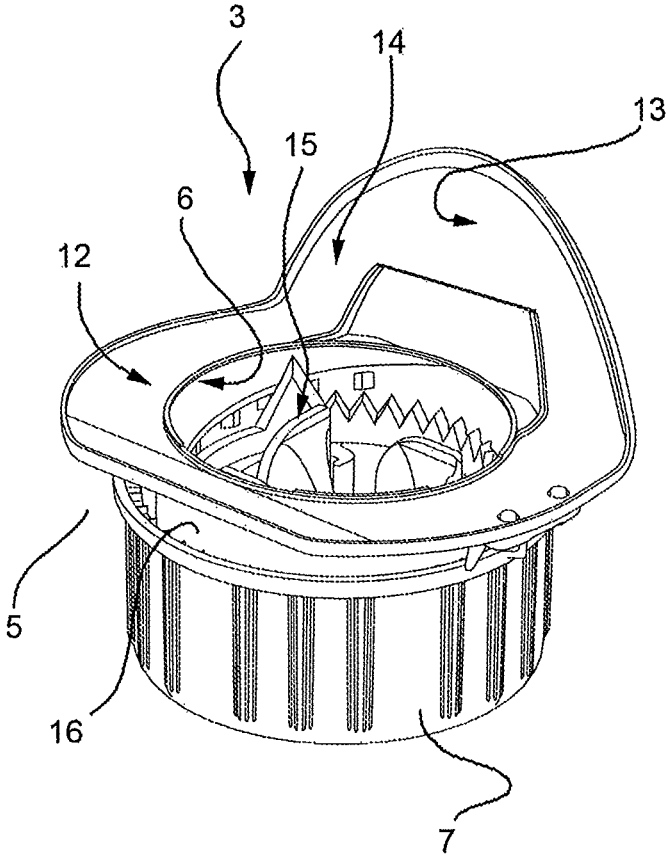
FIG. 7 shows an enlarged view of the opening device subjected to pressure by the FIG. 1-6 pressure device.

The FIG. 7 enlargement shows one example of an opening device 3, to which reference is made in the following description purely by way of a non-limiting example.

Opening device 3 substantially comprises:

- a frame 5 which is applied about the removable portion of package 2, and has a circular opening 6 through which the food product is poured;
- a removable screw cap 7 fitted to frame 5 to close opening 6; and
- a cutting member 15 which, in use, engages opening 6 and interacts with the removable portion of package 2 to partly detach the removable portion from the rest of the packaging material and so open package 2.

Frame 5 straddles an edge between two adjacent walls of package 2, e.g. a top wall 8 and a top end portion 9 of a lateral wall 10 adjacent to wall 8 (FIG. 6), and comprises two fastening portions 12, 13 at a predetermined angle to each other.

More specifically, in the gluing unit, portions 12, 13 are coated with adhesive, normally hot-melt glue, and, in the application unit, are fitted to wall 8 and portion 9 of wall 10 of package 2 respectively.

Frame 5 comprises a flange 14 defining portions 12, 13; and a threaded collar 16 defining opening 6 and for receiving cap 7.

Portion 12 is substantially annular, and portion 13 projects from portion 12 on the opposite side to collar 16.

The angle between portions 12, 13 of flange 14, on the opposite side, in use, to walls 8 and 10 of package 2, is preferably 90° or over and less than 180°.

On the opposite side to flange 14, cap 7 is bounded by a flat surface 11 sloping at an acute angle with respect to wall 8 of package 2.

On the opposite side to portion 13, flange 14 also comprises a flat wall 14*a* sloping with respect to portion 13 and wall 8, and substantially perpendicular to surface 11.

Collar 16 projects from flange 14 and, once opening device 3 is applied to package 2, extends from the opposite side of flange 14 to the side facing the top wall and lateral wall of package 2.

With reference to FIG. 1, unit 1 substantially comprises:

- a fixed supporting structure 17;
- a conveyor 18 for feeding packages 2, fitted with opening devices 3, in a direction A from a start station 19*a* to an end station 19*b;*
- a conveyor 20 supported by structure 17; and
- a number of pressure devices 25 which project from a belt 21, are fed by conveyor 20 along an endless path P of the same shape as belt 21, and exert pressure on respective opening devices 3 travelling in direction A.

More specifically, conveyor 20 comprises an endless cog belt 21 wound onto a drive sprocket wheel 22 powered by a motor 23, and onto a return sprocket wheel 24; and pressure devices 25 project from belt 21 on the opposite side to sprocket wheels 22, 24.

Path P comprises a work portion $P_1$, along which pressure devices 25 exert pressure on opening devices 3 on respective packages 2; and a return portion $P_2$, along which pressure devices 25 reposition with respect to packages 2 travelling parallel to direction A.

Work portion $P_1$ is straight and parallel to direction A, and is travelled by pressure devices 25 at the same speed as packages 2 in direction A. Return portion $P_2$ comprises two arc-shaped portions upstream and downstream from work portion $P_1$; and a straight portion opposite work portion $P_1$ and parallel to direction A.

Each pressure device 25 (FIGS. 2, 3, 4, 5) advantageously comprises a finger 26 movable between a first work position, in which it exerts pressure on portion 12 of opening device 3 on wall 8 of package 2, and a first rest position, in which it is detached from opening device 3; and a finger 27 movable between a to second work position, in which it exerts pressure on portion 13 of opening device 3 on portion 9 of wall 10 of package 2, and a second rest position, in which it is detached from opening device 3.

More specifically, finger 26 and finger 27 of each pressure device 25 are movable independently between their respective first and second work and rest positions.

Finger 26 and finger 27 of each pressure device 25 cooperate respectively with surface 11 and wall 14*a* of opening device 3 to respectively exert pressure on portions 12, 13 of opening device 3 on wall 8 and portion 9 of wall 10 of package 2 long enough to allow the adhesive to cool and each opening device 3 to adhere firmly to package 2.

Unit 1 also comprises a cam 31 (FIGS. 1 and 3) which, along work portion $P_1$ of path P, cooperates cyclically with a roller 28 on each pressure device 25 to move respective finger 26 between its first rest and work positions.

Unit 1 also comprises a cam 36 (FIGS. 1 and 4) which, along work portion $P_1$ of path P, cooperates cyclically with a roller 29 on each pressure device 25 to move respective finger 27 between its second rest and work positions.

Cam 31 is fixed to structure 17 and located on the opposite side of belt 21 to sprocket wheels 22, 24. More specifically, cam 31 is located on the direction A side of belt 21.

Cam 31 is substantially in the form of a vertical plate elongated parallel to direction A.

Cam 31 comprises a profile 32 which cooperates with rollers 28 of pressure devices 25 applied to packages 2 travelling parallel to direction A.

From start station 19*a* to station 19*b*, profile 32 comprises:

- a curved portion 33 extending closer and closer to conveyor 18 and therefore to opening devices 3 fitted to packages 2 travelling in direction A;
- a portion 34 parallel to direction A and extending at a constant distance from conveyor 18 and therefore from opening devices 3 fitted to packages 2 travelling in direction A; and
- a straight portion 35 sloping with respect to direction A and extending further and further away from conveyor 18 and therefore from opening devices 3 fitted to packages 2 travelling in direction A.

More specifically, portion 33 slopes downwards, and portion 35 upwards with respect to direction A.

Cam 31 is so designed that roller 28 of each pressure device 25 travels in a direction Y, getting closer and closer to opening device 3, as it cooperates with portion 33; remains in contact with surface 11 of opening device 3, as it cooperates with portion 34; and travels in direction Y, getting further and further away from opening device 3, as it cooperates with portion 35.

More specifically, roller 28 of each pressure device 25 is lowered in direction Y towards conveyor 18, as it cooperates with portion 33; and is raised with respect to conveyor 18, as it cooperates with portion 35.

Figure 6:
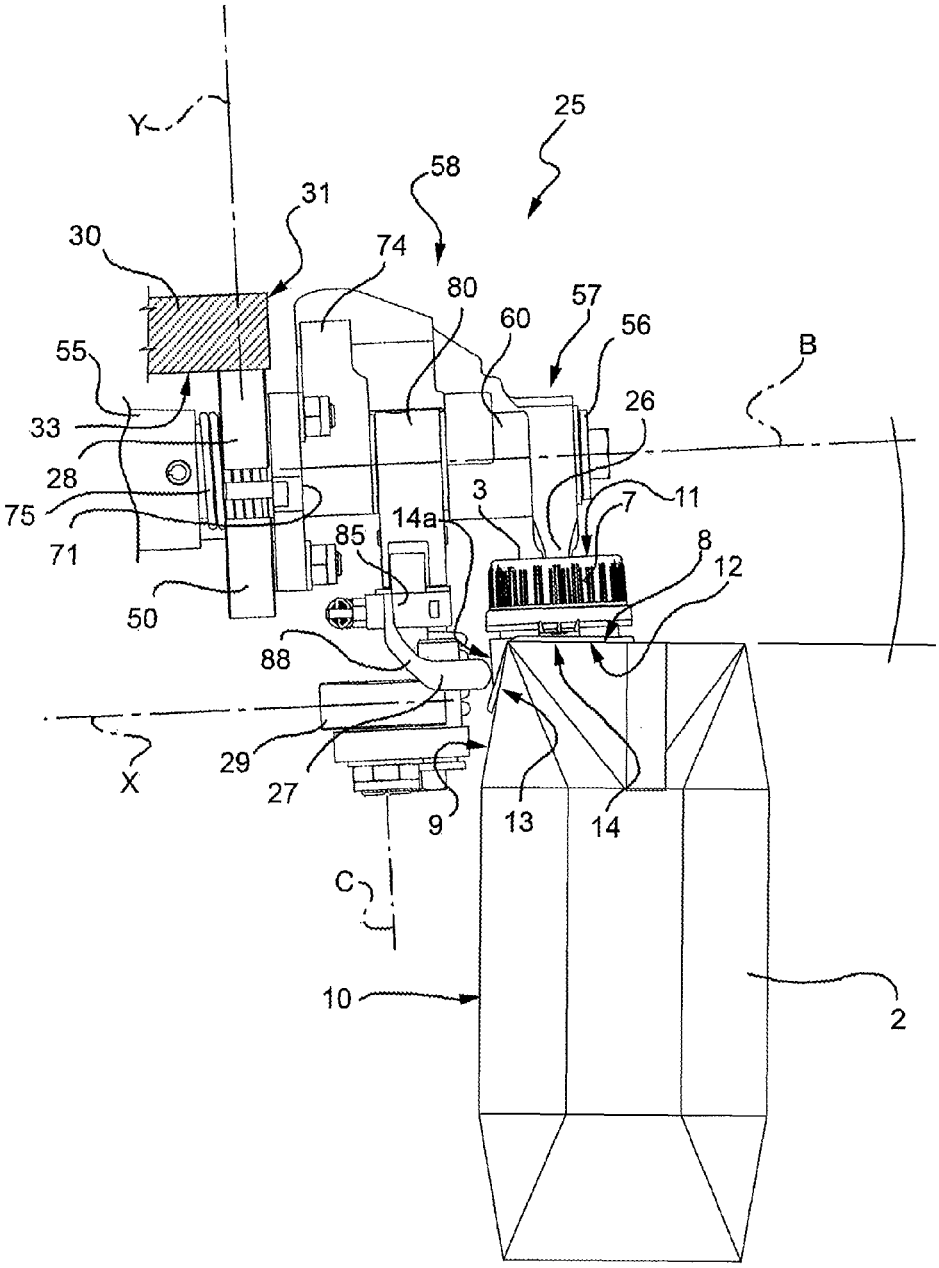
FIG. 6 shows the FIG. 1-5 pressure device exerting pressure on an opening device fitted to a respective package.

In the example shown, direction Y is parallel to the plane of wall 14*a* of relative opening device 3, and forms an acute angle with the vertical (FIG. 6).

Unit 1 (FIG. 1) also comprises a wall 41 which defines a guide surface 42 cooperating cyclically with a roller 50 on each pressure device 25 along return portion $P_2$; a surface 43 cooperating cyclically with roller 50 of each pressure device 25 along an initial portion of work portion $P_1$; and a cam 44 which cooperates with roller 50 of each pressure device 25 at the end of work portion $P_1$ to restore finger 26 to the first rest position.

More specifically, roller 50 of each pressure device 25 is integral with relative roller 28 in direction Y.

Cam 36 (FIGS. 1 and 3) is fixed to structure 17 and located on the opposite side of belt 21 to sprocket wheels 22, 24. More specifically, cam 36 is located on the direction A side of belt 21.

Cam 36 comprises a profile 37 located on the opposite side to belt 21, and therefore on the side facing opening devices 3, and which cooperates cyclically with roller 29 of each pressure device 25 travelling along work portion $P_1$ of path P.

From start station 19*a* to end station 19*b*, profile 37 comprises:

- a straight portion 38*a* parallel to direction A;
- a straight portion 38*b* converging towards direction A so as to extend closer and closer to opening devices 3 fitted to packages 2 travelling in direction A;
- a portion 39 parallel to direction A and extending at a constant distance from opening devices 3 fitted to packages 2 travelling in direction A; and
- a straight portion 40 diverging from direction A so as to extend further and further away from opening devices 3 fitted to packages 2 travelling in direction A.

Roller 29 of each pressure device 25 travels in a direction X, getting closer and closer to wall 14*a* of opening device 3, as it cooperates with portion 38*b*; cooperates with an exerts pressure on wall 14*a* as it cooperates with portion 39; and travels in direction X, getting further and further away from wall 14*a*, as it cooperates with portion 40.

More specifically, direction X is perpendicular to direction Y.

In the example shown, direction X is substantially parallel to surfaces 11 of caps 7 of opening devices 3, and forms an acute angle with the horizontal (FIG. 6).

Each pressure device 25 (FIGS. 2 to 6) substantially comprises:

- a plate 55 fixed to belt 21, on the opposite side to sprocket wheels 22, 24;
- a pin 56 which has an axis B parallel to direction X, projects from plate 55 on the opposite side to belt 21, and is fixed with respect to axis B;
- a rocker arm 57 rotating with respect to pin 56 about axis B, and supporting finger 26; and
- a rocker arm 58 rotating with respect to pin 56 about axis B, and connected functionally to rollers 28, 50 and elastically to rocker arm 57 to convert translation of relative rollers 28, 50 in direction Y to rotation of rocker arm 57 about axis B.

More specifically, rollers 28, 50 of each pressure device 25 rotate about respective axes parallel to direction X and to axis B of relative pin 56, and positioned horizontally in use.

Rocker arm 57 of each pressure device 25 substantially comprises an annular portion 60 fitted to pin 56 to rotate about axis B; an arm 61 projecting from portion 60 in a direction substantially radial with respect to axis B, and fitted with finger 26 on its free end opposite axis B; and an appendix 63 projecting from portion 60, on the opposite side to arm 61.

More specifically, each appendix 63 projects from respective portion 60 on the opposite side to rollers 28, 50, and each arm 61 projects from respective portion 60 on the same side as rollers 28, 50.

Each finger 26 is also bent towards opening device 3 of relative package 2.

Each rocker arm 58 comprises integrally:

a cylindrical portion 70 fitted to relative pin 56 to rotate about axis B;

a triangular flange 71 projecting from portion 70 towards rollers 28, 50, and connected to rollers 28, 50 to allow them to rotate about their respective axes;

an arm 72 projecting from portion 70 radially with respect to axis B and on the opposite side to rollers 28, 50, and connected to an underside surface of appendix 63 of relative rocker arm 57 by a coil spring 73; and an arm 74 projecting from portion 70 and bent over a topside surface of appendix 63 of relative rocker arm 57.

Each pressure device 25 also comprises a coil spring 75 coaxial with relative pin 56 and interposed between relative plate 55 and relative flange 71.

Each spring 75 loads relative finger 26 into the first rest position.

Figure 4:
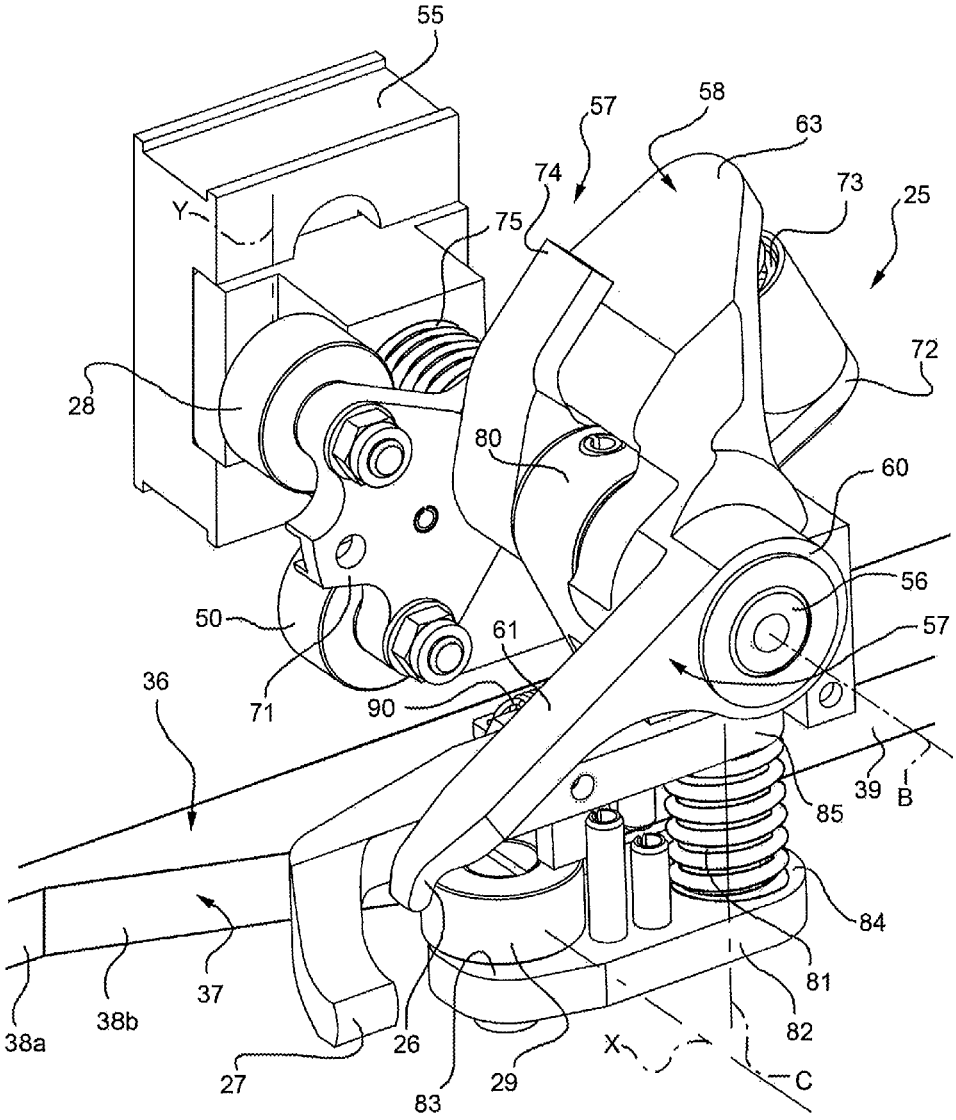
FIG. 4 shows a view in perspective of the FIG. 3 pressure device.
Figure 5:
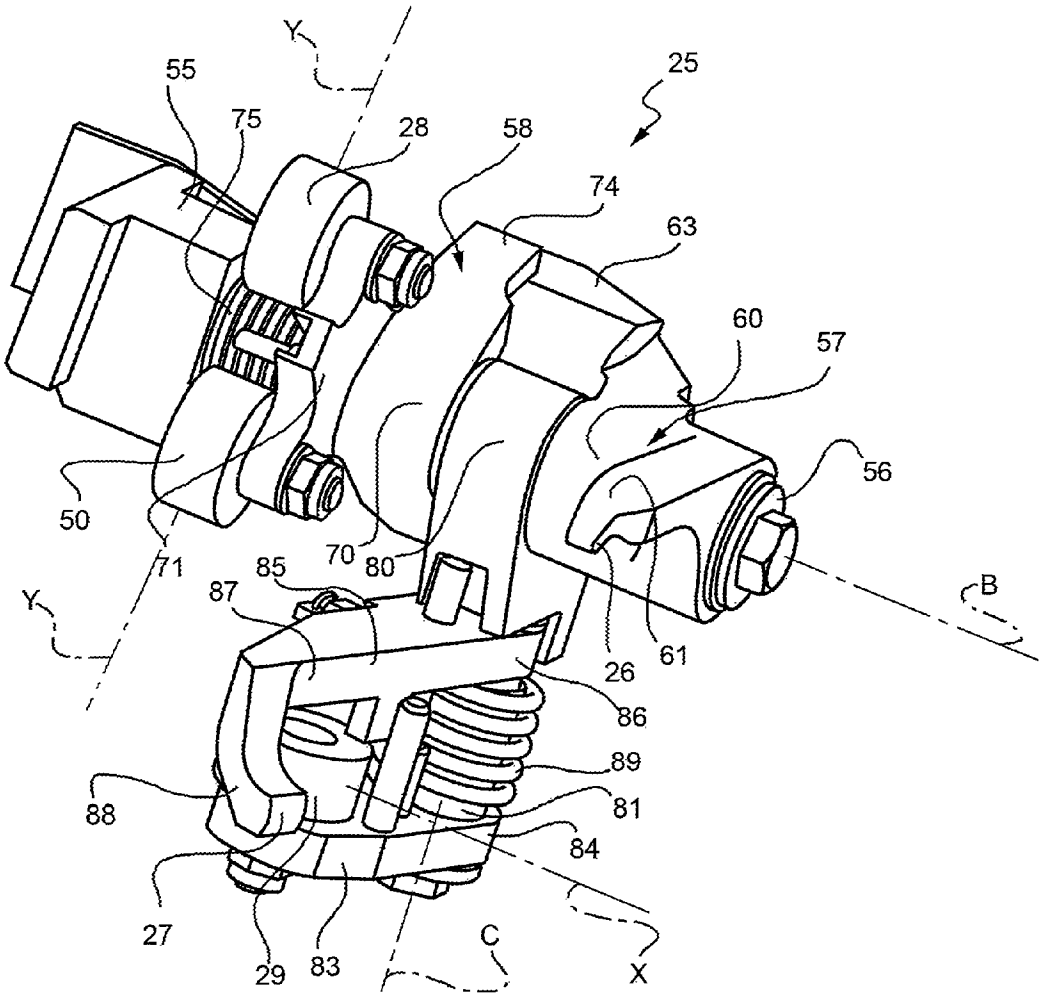
FIG. 5 shows a view in perspective of the FIG. 4 pressure device from a different angle.

More specifically, each spring 75 is preloaded to torque relative flange 71 and rocker arms 57, 58 anticlockwise, in FIGS. 2 and 4, about axis B to restore relative finger 26 to the first rest position as relative roller 28 cooperates with portion 35 of profile 32 of cam 31.

Each pressure device 25 also comprises:

a body 80 supported by pin 56 in a fixed angular position with respect to axis B;

a pin 81 which is elongated along an axis C parallel to direction Y, is fixed with respect to axis C, and has a first end connected to body 80;

a lever 82 which has a first end 83 fitted with roller 29, and a second end 84 connected to a second end of pin 81, and rotates with respect to pin 81 about axis C; and an arm 85 which rotates with respect to pin 81 about axis C, is fitted, at the opposite end to pin 81, with finger 27, and is connected elastically to lever 82 by a coil spring 89 coaxial with pin 81.

More specifically, each body 80 is fitted to pin 56 between portions 60, 70 of respective rocker arms 57, 58 along axis B of pin 56.

Arm 85 comprises an end 86 connected to pin 81 in rotary manner about axis C; a main portion 87 radial with respect to pin 81; and a free end 88 bent with respect to main portion 87 and away from cam 36, and defining finger 27.

More specifically, finger 27 of each pressure device 25 defines a flat contact surface which cooperates with wall **14*b* of relative opening device 3**.

Each roller 29 rotates about a respective axis parallel to direction Y.

Finally, each pressure device 25 comprises a coil spring 90 (FIG. 4) interposed between body 80 and arm 85 to preload finger 27 into the second rest position.

More specifically, each spring 90 is preloaded to torque arm 85 anticlockwise substantially about an axis parallel to axis C to restore finger 27 to the second rest position when roller 28 cooperates with portion 39 of profile 37 of cam 36.

In actual use, conveyor 20 moves pressure devices 25 cyclically along path P.

More specifically, as they travel along return portion $P_2$, rollers 50 of pressure devices 25 cooperate with surface 42 of wall 41, and fingers 26 and 27 are set to the first and second rest position respectively.

At the same time, packages 2, fitted with respective opening devices 3, reach start station **19*a* and are fed parallel to direction A by conveyor 18**.

Operation of unit 1 will now be described with reference to one pressure device 25 located at start station **19*a*, with fingers 26 and 27** in the first and second rest position respectively.

The movement of belt 21 causes roller 28 to cooperate with portion 33 of cam 31.

The down-sloping shape of portion 33 towards conveyor 18 moves roller 28 in direction Y integrally with roller 50.

Figure 3:
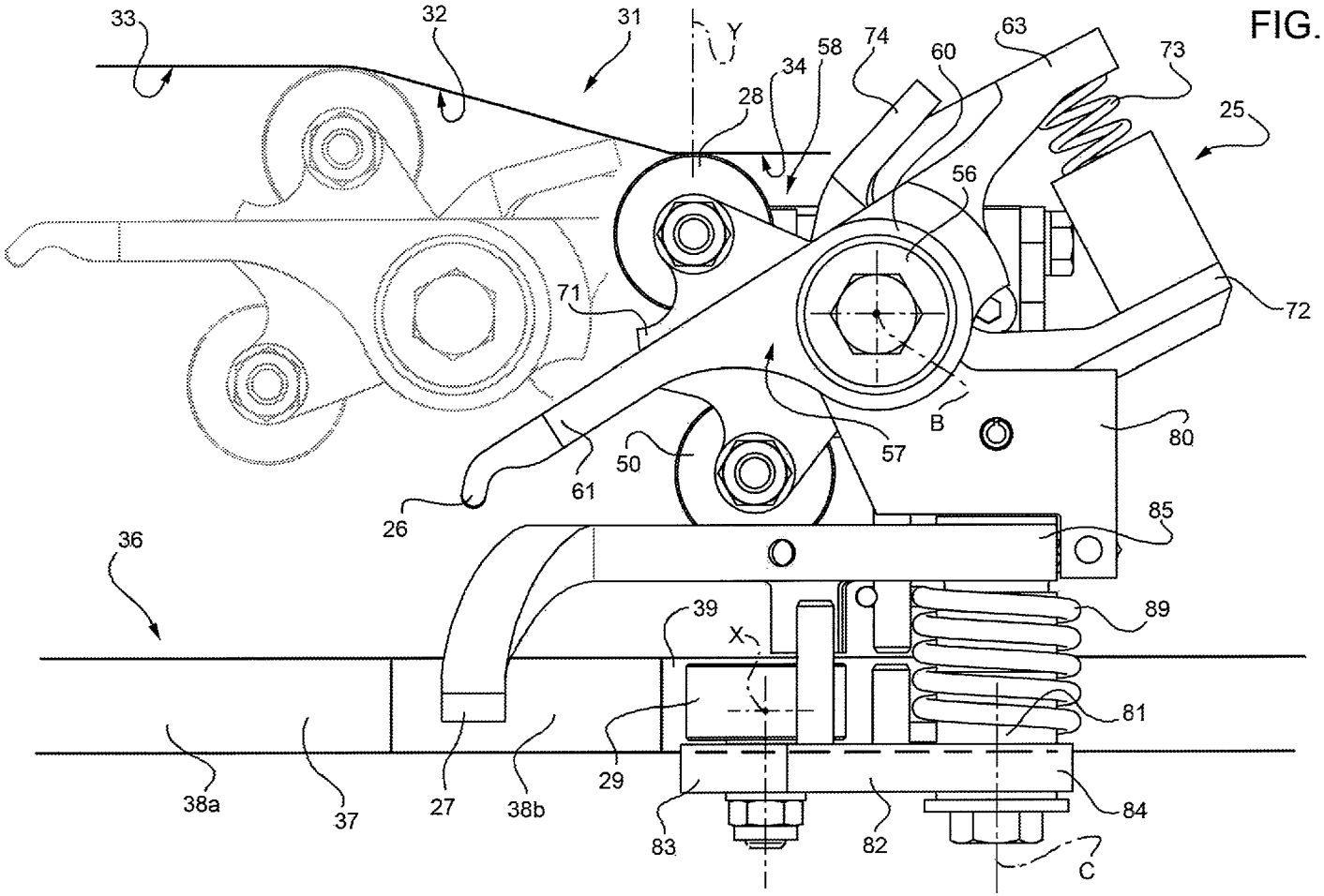
FIG. 3 shows an enlarged front view of a pressure device in FIGS. 1 and 2.

The movement of roller 28 in direction Y rotates rocker arm 57 anticlockwise, in FIGS. 3 and 4, about axis B.

By means of spring 73, rotation of rocker arm 57 about axis B rotates rocker arm 58 anticlockwise, in FIGS. 3 and 4, about axis B, so finger 26 moves from the first rest position to the first work position.

Before finger 26 reaches the first work position and contacts surface 11 of cap 7, spring 73 remains substantially undeformed, so that arm 72 and appendix 63 rotate integrally about axis B.

As roller 28 travels along an end portion of portion 33, rotation of rocker arm 57 about axis B brings finger 26 into contact with surface 11 of cap 7 of opening device 3, to exert pressure on surface 11 of cap 7 substantially in direction Y.

As roller 28 moves down further towards conveyor 18, rocker arm 58 rotates further anticlockwise (in FIGS. 3 and 4), while rocker arm 57 remains stationary with finger 26 pressing on surface 11 of cap 7.

As a result, spring 73 gets slightly shorter, so that arm 72 moves slightly closer to appendix 63.

Roller 28 then begins cooperating with portion 34 of cam 31.

Because portion 34 extends at a constant distance from conveyor 18, finger 26 presses surface 11 of cap 7, and therefore portion 12 of flange 14 of opening device 3, against wall 8 of package 2 long enough for portion 12 to adhere firmly to wall 8.

Next, roller 28 rolls along portion 35 of cam 31, and, at the same time, roller 50 cooperates with profile 45 of cam 44.

Because portion 35 of cam 31 and profile 45 extend gradually away from conveyor 18, rollers 28 and 50 roll upwards in direction Y away from conveyor 18.

The upward movement of rollers 28, 50 rotates rocker arms 57, 58 clockwise (in FIGS. 3 and 4) about axis B, thus withdrawing finger 26 from opening device 3.

Withdrawal of finger 26 is aided by spring 75, which rotates rocker arm 57 clockwise about axis C.

By the time rollers 28, 50 complete portion 35 and profile 45 respectively, finger 26 is in the first rest position.

As roller 28 cooperates with portion 33, roller 29 cooperates with portion **38*b* of cam 36**.

Since, from start station **19*a* towards end station 19*b*, portion 38*b* extends gradually away from belt 21, roller 29 rolls away from belt 21** in direction X.

The movement of roller 29 in direction X rotates about axis C lever 82 and, by means of spring 89, arm 85 supporting finger 27.

The movement of roller 29 in direction X also stretches spring 90.

Before finger 27 contacts portion 13 of flange 14, lever 82 and arm 85 rotate integrally about axis C.

Once finger 27 contacts portion 13, arm 85 moves slightly closer to lever 82, thus slightly compressing spring 89.

At this point, further travel of pressure device 25 along path P causes roller 29 to cooperate with portion 39 of cam 36.

Because portion 39 extends at a constant distance from belt 21, finger 27 cooperates with wall **14*a* of cap 7 and presses portion 13 against portion 9 of wall 10 long enough for portion 13 to adhere firmly to portion 9**.

Further travel of pressure device 25 along path P causes roller 29 to cooperate with portion 40 of cam 36.

At this point, spring 90 contracts, thus rotating arm 85 about axis C in such a direction as to withdraw finger 27 from wall 14*a* of opening device 3.

At the same time, spring 89 rotates lever 82 about axis C, and moves roller 29 towards belt 21 in direction X.

By this time, portions 12, 13 are stuck firmly to wall 8 and portion 9 of wall 10 respectively of package 2, which can now be fed downstream from unit 1.

Pressure device 25 travels along portion $P_1$ of path P with fingers 26 and 27 in the first and second rest position respectively.

The advantages of pressure device 25 according to the present invention will be clear from the above description.

In particular, fingers 26 and 27 of each pressure device 25 provide for exerting pressure on both surface 11 and wall 14*a* of opening device 3 to ensure firm adhesion of portions 12, 13 to respective walls 8, 10 of package 2.

As such, pressure device 25 is highly flexible as regards the shape and spatial orientation of the area of opening device 3 to which pressure is applied.

Clearly, changes may be made to pressure device 25 without, however, departing from the protective scope defined in the accompanying Claims.

The invention claimed is:

1. A pressure device for exerting pressure on an opening device to be adhered to a package of a food product, the pressure device comprising:

a first pressure member movable between a first work position, in which the first pressure member presses a first area of said opening device against a first wall of said package to adhere the first area of the opening device to the first wall, and a first rest position, in which the first pressure member is detached from said opening device; and a second pressure member movable between a second work position, in which the second pressure member presses a second area of said opening device against a second wall of said package which is crosswise to the first wall of said package to adhere the second area of the opening device to the second wall, and a second rest position, in which the second pressure member is detached from said opening device; said first and said second area being crosswise to each other.

2. A device as claimed in claim 1, wherein said first pressure member is movable between said first work position and said first rest position in a first movement which is independent of a second movement in which said second pressure member is movable between said second work position and said second rest position.

3. A unit for exerting pressure on a succession of opening devices fitted to respective packages of food products pourable into a tube of packaging material; the unit comprising:

a number of pressure devices as claimed in claim 2 and movable cyclically along an endless path;

first cam means interacting cyclically with said first cam followers of respective pressure devices along a first portion of said endless path to move the respective said first pressure members from the respective said first rest positions to the respective first work positions; and second cam means interacting cyclically with said second cam followers of respective pressure devices along said first portion of said endless path to move the respective said second pressure members from the respective said second rest positions to the respective second work positions.

4. A device as claimed in claim 1, comprising: at least a first cam follower connected functionally to said first pressure member; and a second cam follower connected functionally to said second pressure member.

5. A device as claimed in claim 3, wherein:

said first pressure member rotates about a first axis to move along a first work path between said first work position and said first rest position;

and said first cam follower is movable in a first direction crosswise to said first axis;

said first cam follower and said first pressure member being connected to each other so that translation of said first cam follower in said first direction rotates said first pressure member about said first axis.

6. A device as claimed in claim 5, comprising:

a first rocker arm rotating about said first axis and connected to said first cam follower; and first elastic means interposed between said first rocker arm and said first pressure member.

7. A device as claimed in claim 6, comprising:

a first pin elongated along said first axis and fixed with respect to said first axis; and said first rocker arm and said first pressure member rotating about said first axis with respect to said first pin.

8. A device as claimed in claim 7, comprising:

a plate, with respect to which said first cam follower is movable parallel to said first direction; and second elastic means interposed between said plate and said first rocker arm, and which load said first rocker arm into a first angular position, with respect to said first axis, in which said first pressure member is in said first rest position.

9. A device as claimed in claim 7, comprising:

a second rocker arm rotating about said first axis with respect to said first pin;

said second rocker arm in turn comprising an arm elongated substantially radially with respect to said first axis and having a curved end defining said first pressure member;

said second rocker arm further comprising an appendix on a side of said first axis opposite to said arm, and connected to said first rocker arm by said first elastic means.

10. A device as claimed in claim 9, comprising:

a first lever having a first end connected to said second cam follower; and third elastic means interposed between said second pressure member and a second end opposite said first end of said lever.

11. A device as claimed in claim 10, comprising:

a second pin elongated along said second axis and fixed with respect to the second axis; and said first lever and said second pressure member rotating about said second axis with respect to said second pin.

12. A device as claimed in claim 11, comprising:

a second lever rotating about said second axis with respect to said second pin, and defining, on its end opposite said second axis, said second pressure member.

13. A device as claimed in claim 5, comprising:

said second pressure member rotates about a second axis, crosswise to said first axis, to move along a second work path between said second work position and said second rest position;

said second cam follower being movable in a second direction crosswise to said second axis; and said second cam follower and said second pressure member being connected to each other so that translation of said second cam follower in said second direction rotates said second pressure member about said second axis.

14. A device as claimed in claim 13, comprising:

a body fixed with respect to said first axis, and with respect to which said second pressure member rotates about said second axis; and fourth elastic means interposed between said body and said second pressure member, and which load said second pressure member into said second rest position.

15. A device as claimed in claim 13, comprising:

a second axis parallel to said first direction; and said first axis is parallel to said second direction.

16. A device as claimed in claim 1, further comprising:

a first biasing member which biases the first pressure member to rotate in a first direction in which the first pressure member presses the first area of the opening device against the package; and a second biasing member which biases the first pressure member to rotate in a second direction in which the first pressure member is detached from the opening device, the second direction being different from the first direction.

17. A device as claimed in claim 1 further comprising a carrying element, the first pressure member and the second pressure member being carried by the carrying element.

18. A device as claimed in claim 1, wherein the first pressure member is axially moved in a first direction by a movable conveyor when the first pressure member is in the first work position; and the second pressure member is axially moved in the first direction by a movable conveyor when the second pressure member is in the second work position.

19. A pressure device for exerting pressure on an opening device fitted to a package of a food product, the pressure device comprising:

a first pressure member movable between a first work position, in which the first pressure member presses a first area of the opening device against the package, and a first rest position, in which the first pressure member is spaced from the opening device, the first pressure member rotating about a first axis and being movable in a first direction; and a second pressure member movable between a second work position, in which the second pressure member presses a second area of the opening device against the package, and a second rest position, in which the second pressure member is spaced from the opening device, the second pressure member rotating about a second axis and being movable in a second direction;

the second axis being parallel to the first direction;

the first axis being parallel to the second direction; and the first and the second areas being crosswise to each other.

20. The pressure device according to claim 19, wherein the second axis is parallel to and spaced from the first direction;

the first axis is parallel to and spaced from the second direction.

21. A method for exerting pressure on an opening device fitted to a package of a food product, the method comprising:

pressing a first area of the opening device against a first portion of the package;

pressing a second area of the opening device against a second portion of the package, the first and the second areas being different from each other and crosswise to each other, the first and the second portions of the package being different from each other and crosswise to each other;

the pressing of the first and second area of the opening device causing the opening device to be pressed against the package of the food product.

22. The method according to claim 21, wherein the first portion of the package is on a top wall of the package;

the second portion of the package is on a side wall of the package different from the top wall of the package.

* * * * *